United States Patent [19]

Saferstein

[11] 4,095,787

[45] Jun. 20, 1978

[54] WORKOUT DEVICE FOR TENNIS HAVING A VARIABLE SPEED CONTROL

[76] Inventor: Albert Saferstein, 4797 Boston Post Rd., Pelham Manor, N.Y. 10803

[21] Appl. No.: 669,465

[22] Filed: Mar. 22, 1976

[51] Int. Cl.[2] ..... A63B 61/00

[52] U.S. Cl. ..... 273/29 A; 273/26 E; 273/95 A

[58] Field of Search ..... 273/26 E, 29 A, 95 A, 273/58 C, 200 R, 200 A, 200 B, 197 R, 197 A, 184 B, 185 C, 185 D, 1.5 R; 272/26 E, 77, 78; 43/43.1, 43.13; 59/95, 9; 24/73 R, 73 RM, 73 A, 129 A

[56] References Cited

U.S. PATENT DOCUMENTS

| | | | |
|---|---|---|---|
| 1,708,796 | 4/1929 | Lawrence | 273/29 A |
| 2,139,294 | 12/1938 | Weigant | 59/95 X |
| 2,243,620 | 5/1941 | Fernandec | 273/29 A |
| 2,514,840 | 7/1950 | Charles | 59/95 X |
| 2,747,873 | 5/1956 | Carroad | 273/95 A |
| 3,200,459 | 8/1965 | Hartman | 59/95 X |
| 3,262,703 | 7/1966 | Hodlick | 273/95 A |
| 3,540,726 | 11/1970 | Davis | 273/26 E |
| 3,841,631 | 10/1974 | Dolan | 273/1.5 R |

FOREIGN PATENT DOCUMENTS

| | | | |
|---|---|---|---|
| 21,210 | 2/1936 | Australia | 273/29 A |
| 39,756 | 3/1932 | France | 273/29 A |
| 697,207 | 1/1931 | France | 273/29 A |
| 297,660 | 8/1928 | United Kingdom | 273/95 A |

OTHER PUBLICATIONS

Mechanics Illustrated, Jan. 1971, p. 57.

*Primary Examiner*—Richard C. Pinkham
*Assistant Examiner*—T. Brown
*Attorney, Agent, or Firm*—Lackenbach, Lilling & Siegel

[57] ABSTRACT

A device for practicing tennis rebounds comprising an anchor or weighted base, a tennis ball and a generally elastic cord connected therebetween. The line or cord is provided with adjusting means for varying the length of the cord from a maximum length to one-half thereof, thereby enabling the ball return speed to be controlled by setting a desired or predetermined length for the elastic cord. The greater the length of the elastic cord, the slower the return of the tennis ball.

8 Claims, 5 Drawing Figures

10
12
14
16
18
20
22
23
24
26
28
30
32
34
36
38
40
42
44
46
48
50
52
54
56
58

WORKOUT DEVICE FOR TENNIS HAVING A VARIABLE SPEED CONTROL

BACKGROUND AND SUMMARY OF THE INVENTION

The present invention relates to a device for practicing the game of tennis, whereby a player may play or practice together with one or more other players or by playing alone.

The device is in the form of a tethered ball game. Numerous such apparatus have been developed heretofore, such as, for example, the devices shown in U.S. Pat. Nos. 2,772,882; 3,031,191; 2,747,873; 1,708,796; 1,528,909; 3,693,972; 3,776,551; 3,764,140; 3,601,398; 3,804,409; 3,809,406; 2,917,720; 2,307,905; 3,498,613; 1,655,599; British Pat. No. 813,002 and Australian Pat. No. 21,210. However, these devices have been generally developed for games other than tennis and they all primarily include complex tethering lines or cords.

Other various tennis trainers have been marketed heretofore by Tennis-For-One, of 100 Merrick Road, Rockville Centre, N.Y. 11570 and by Bancroft Sporting Goods Co., Woonsocket, R.I., the latter under the name of "Tretorn Tennis Trainer". These devices are essentially similar in concept consisting of a tennis ball attached by an elastic cord to an anchor base. However, neither of these tennis trainers, nor any of the above-noted patents, provides an adjustable elastic cord between the ball and a fixed base.

It is therefore an object of the invention to provide a novel self-workout device for tennis which is relatively simple in construction and one which enables a player to improve his tennis skills by controlling the speed and return of the tennis ball.

It is also another object of the invention to provide a device which is capable of being adjusted so that the ball return speed can be varied from generally fast to slow.

In accordance with an illustrative embodiment demonstrating objects and features of the present invention, there is provided a device which comprises a generally elastic cord having opposite ends and a ball secured to one end of the cord. Adjustment means is provided on said elastic cord for shortening or lengthening the cord, and anchoring means is provided for securely fastening the other end of the elastic cord to the ground or other flat surface. With such adjustment means, the ball return speed can be greatly varied to suit the skill of any player. Generally, a player initially sets the length of cord to a desired dimension and adjusts the length thereafter, as desired, depending upon his or her consistency in returning the ball by hitting it each time it rebounds back to the player.

BRIEF DESCRIPTION OF THE DRAWING

The above brief description as well as further objects, features and advantages of the present invention will be more fully understood by reference to the following description of the presently preferred but nonetheless illustrative embodiment in accordance with the present invention, when taken in conjunction with the accompanying drawing, wherein.

DESCRIPTION OF THE PREFERRED EMBODIMENTS

Figures 1, 2, 3, 4, 5:
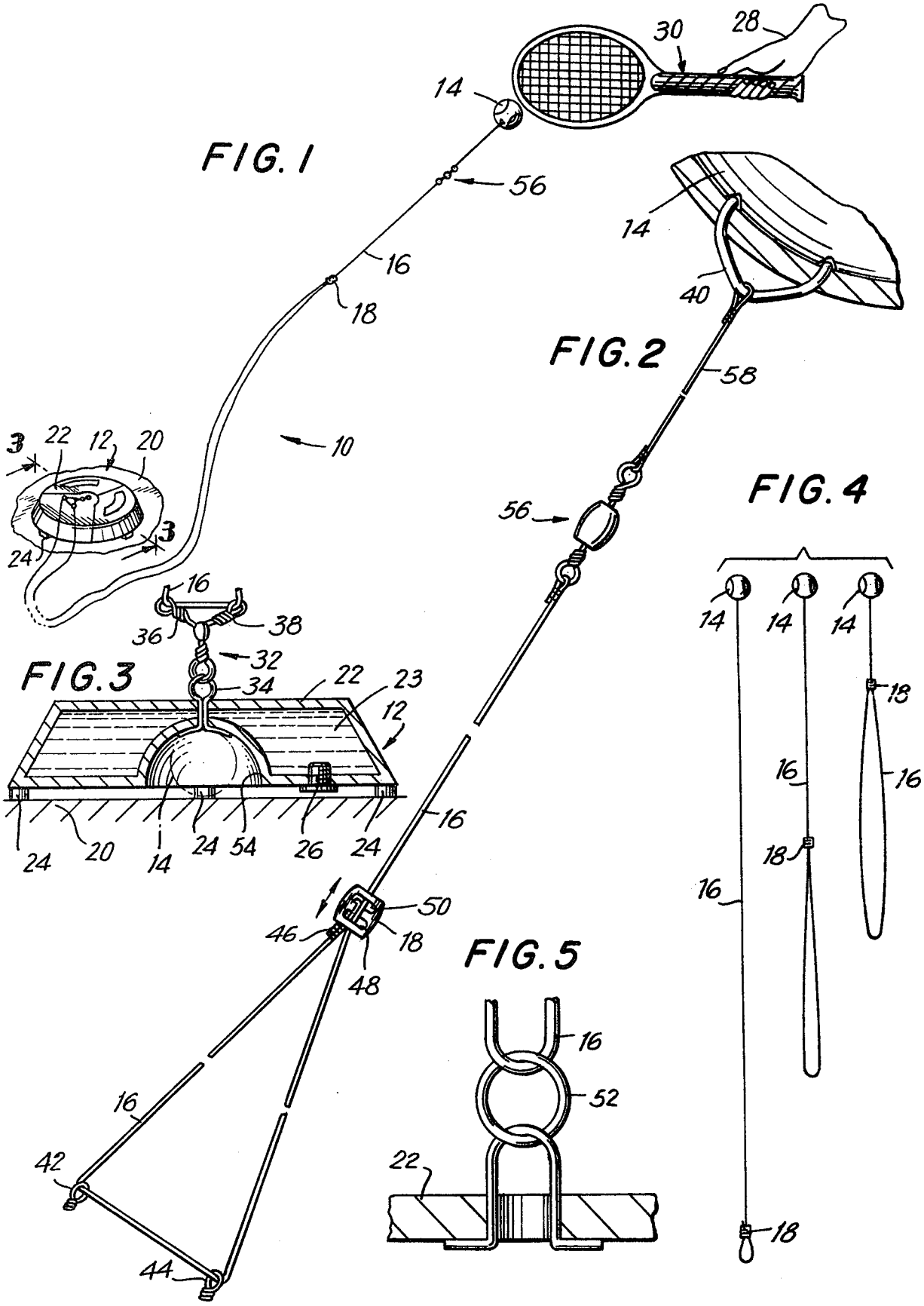
FIG. 1 is a perspective view of the tennis self-workout device or variable speed tennis trainer of the present invention, as it would be stroked by a player upon the ball's return after being hit.
FIG. 2 is a greatly enlarged view of the adjustable means for varying the ball return speed.
FIG. 3 is a sectional view, taken along the line 3—3 of FIG. 1.
FIG. 4 is a side elevational view of three "typical string lengths" representing slow, medium and fast return speeds.
FIG. 5 is an alternate connection means between the base and the cord or string.

While only the preferred forms of the invention are shown, it should be understood that various changes or modifications may be made within the scope of the claims attached hereto without departing from the spirit of the invention.

Referring now to the figures and more particularly to FIG. 1, there is shown an anchored ball game device 10 comprising a weighted base 12, a tethered ball 14, and a connecting elastic line or cord 16 having ajdusting means 18. The base 12 is positioned on the ground 20 or other suitable substrate, and as best shown in FIG. 3, it suitably comprises a hollow housing 22. The housing 22 is provided with a plurality of feet 24 and a removable plug 26. The plug 26 enables one to readily fill the housing 22 with any suitable heavy fluid material 23, such as sand, water or the like.

In FIG. 1, the player's hand 28 is shown holding a racket 30, and the player should generally stand in the vicinity of the base, for example, either in front or behind the base and generally along side thereof. Upon hitting the ball 14 with the racket 30, the ball travels for the length of the elastic cord 16 and then returns back to the player in a somewhat "whipping" manner. The return rebound or recoil given to the ball depends primarily on the length of the elastic cord 16. Thus, as shown in FIG. 4, the full length of the elastic cord 16 shown at the left of said figure provides the slowest return on the ball, while the right side of said figure illustrates a half length elastic cord having about twice the return speed as the former case. The middle view in said figure represents an intermediate or medium speed position as it shows the length of the elastic cord as being somewhere between the maximum length and half-length.

A Y-like element or yoke 32 is connected to said base 12 by means of a loop element 34. Such loop element 34 is somewhat like a cotter pin and is mounted in said base 12 so that it is free to rotate therein or swivel thereabout. The yoke 32 is positioned such that the pair of legs 36 and 38 of the fork section provide a spaced connection for an intermediate section of the elastic cord 16. With a spaced intermediate section of the elastic cord 16 connected to the base 12, there is less likelihood that the elastic cord 16 will become twisted about itself during extensive playing or practicing. Of course, the loop element 34 is in the form of a "swivel" in that it is free to rotate freely about the axis of the aperture in the base 12 to which it is rotatably secured.

A suitable connecting loop 40, as best shown in FIG. 2, preferably made of an elastic material is provided as a means for connecting the elastic cord 16 to the ball 14. Other loops 42 and 44 are provided respectively on the legs 36 and 38 of the yoke element 32. One end of the elastic cord 16 is generally connected to the elastic loop 40 and the other end 46 is connected to the adjusting means 18. Apertures 48 and 50 in the adjusting means 18 permit the elastic cord 16 to pass therethrough in a "weave-like" manner. With such an adjustment device, the apparatus of the invention is provided with the unique ability to adjust the speed of the ball's return or rebound. Thus, the snap-back or return speed of the ball can be varied by simply moving the adjusting device 18 up or down the length of the elastic cord 16. With the elastic cord 16 at maximum length, the ball returns at the slowest rate, whereas with the shortest possible length of the elastic cord 16 (doubled-up), the ball return speed is at its maximum speed. A player can therefore adjust and control the ball return speed to any desired result depending upon the skill of the player to consistently return the ball by constantly stroking it back into play. Generally, the game is best played when the ball is hit in such a manner as to have the ball return on a single bounce.

A player, of course, can stroke the ball in any desired manner, for example, forehand, backhand, smash shot, etc.

FIG. 5 simply illustrates an alternate connecting means between the base 22 and the elastic cord 16. Here another type of loop or a ring 52 is utilized, although any suitable connection means may be utilized. Even a swivel type connection may be employed, if desired, although the V-shaped device extending through the aperture in the base 22 permits the ring 52 and cord 16 to freely rotate about the axis of the aperture.

It may also be desired for purposes to provide the base 12 with a suitable depression or cavity 54. When the game is not being used, the ball 14 and, if desired, the cord may be stored in a cavity 54 provided in the bottom of the base 12. Alternatively, the elastic cord 16 may be suitably wrapped (not shown) about the base 12, in lieu of storing it in the cavity 54.

A suitable swivel joint device 56 may also be provided between the ball connecting loop 40 and one end of the elastic cord 16. Such swivel means 56 permits the ball 14 to rotate freely and also roll along the ground or floor without winding up the cord 16. A relatively short similar piece of elastic or inelastic cord 58 may be employed to simply connect one end of the swivel joint device 56 to the connecting loop 40, and the other end of the swivel device 56 is connected to the elastic cord 16. It is preferable where a cord 58 is employed to utilize a relatively short (as compared to the length of the elastic cord) inelastic or other like piece of cord, as such a cord lends itself to providing the ball with the duplication of an "actual bounce" and generally aids in controlling the "snap-back" and "hang-up" of the ball to a degree. With an all elastic cord, there is less control of the ball's snap-back and a greater likelihood of its hanging up.

The elastic cord 16 is suitably made from any generally elastic material, such as natural or synthetic rubber, or any other elastomeric material which is strong and capable of withstanding continuous flexing and stretching over literally hundreds of thousands of cycles. The ball may be a conventional tennis ball or other suitable ball, such as a resilient one capable of good rebounding qualities when bounced. The loop 40 is also likewise constructed of a flexible material as the elastic cord 16 and it is suitably securely fastened to the ball by any available means which is strong and yet does not interfere with the playing qualities of the ball. For example, the loop 40 can be secured by means of suitable adhesives to the ball.

It will be appreciated that with a single strand of elastic cord 16 (at its maximum length), the ball return speed is at its slowest since the tension of the elastic cord is at a minimum as it is a function of or based upon the elasticity of the cord. With the elastic cord at half the maximum length (cord is doubled up forming two equal lengths of elastic cord), then the ball return speed would be at its fastest as the tension of the elastic cord would be about double that of the single elastic cord length. Thus, as shown by the directional arrows near the adjusting means 18, moving the means 18 toward the ball increases the ball rebound speed, and moving the means 18 toward the base decreases the ball return speed. The length of the elastic cord 16 may be readily changed by simply holding the adjusting means 18 in one hand and pulling the elastic cord 16 through the apertures 48 and 50 in the desired direction, similarly as one would do in tightening or loosening a conventional belt buckle. One set, the length of the elastic cord is retained in place by the means 18 until it is further adjusted to suit a player's desires.

With just a single line of elastic cord, the shorter the section of cord, the faster the "snap-back". Here with the present invention, the "snap-back" or rebound is fastest with the elastic cord being doubled up as the "spring-tension" of the cord is at its strongest.

With the apparatus of the present invention, a player may practice his timing and stroking. When the ball is hit, it flies out to its farthest extension of the elastic cord and then flies back on a bounce as if hit by an unseen opponent. The player continues to play by hitting the ball again and again so as to keep his or her "rally" going for the longest possible time or period. In effect, the apparatus us almost like practicing against a wall or backboard, in contrast to hitting balls dispensed by a tennis ball throwing machine. The present invention is extremely versatile and by providing the apparatus with an adjustment means, the device can be made more lively by increasing or decreasing the speed of the ball's return. Such variation in the ball's speed can be used to increase one's skill in returning a ball to an opponent and also in improving and developing one's skills with the various tennis strokes used in playing the real game of tennis.

While the invention has been described, disclosed, illustrated and shown in terms of an embodiment or modification which it has assumed in practice, the scope of the invention should not be deemed to be limited by the precise embodiment or modification herein described, disclosed, illustrated or shown, such other embodiments or modifications as may be suggested to those having the benefit of the teachings herein being intended to be reserved especially as they fall within the scope and breadth of the claims here appended.

What is claimed is:

1. An apparatus for practicing tennis by the stroking of a tethered ball comprising an anchor base; a tether line connected to said base having a relatively short inelastic cord connected to an end of a generally long elastic cord, and a ball at one end of said inelastic cord; swivel means; said swivel means being a Y-shaped yoke connection having a pair of legs attached between said base and an intermediate section of said elastic cord, said yoke having loops at each leg thereof and said elastic cord passing through said loops; adjusting means connected to the other end of said elastic cord, said adjusting means also being slidable on said elastic cord intermediate the ends thereof for variably adjusting the length of said elastic cord from substantially between full length and substantially half-length by doubling up upon itself a length of said elastic cord to form a loop; whereby said means for adjusting said cord enables a player to control the return speed or rebound action of said ball from slowest at substantially full length of said elastic cord to fastest at substantially half-length of said elastic cord.

2. The apparatus according to claim 1, wherein said adjusting means comprises a buckle-like device having a pair of apertures, and said elastic cord passing through said apertures.

3. The apparatus according to claim 1, wherein said base comprises a hollow housing adapted to receive a fluid material in said hollow housing.

4. The apparatus according to claim 3, including removable plug means for providing access to said hollow housing.

5. The apparatus according to claim 1, including loop connections between said elastic cord and said ball.

6. The apparatus according to claim 1, including another swivel means disposed between said ball and said tether line.

7. The apparatus according to claim 6, wherein said relatively short inelastic cord is disposed between said ball and said swivel means.

8. The apparatus according to claim 1, wherein said base comprises a generally heavy object placed upon a support surface having sufficient weight to maintain said apparatus in place during use thereof.

* * * * *